US008590449B2

(12) United States Patent
Egan

(10) Patent No.: US 8,590,449 B2
(45) Date of Patent: Nov. 26, 2013

(54) DRY FLEXOGRAPHIC PRINTING PLATE CLEANER SYSTEM AND METHOD

(76) Inventor: Ronald G. Egan, Webster, NY (US)

( * ) Notice: Subject to any disclaimer, the term of this patent is extended or adjusted under 35 U.S.C. 154(b) by 631 days.

(21) Appl. No.: 12/482,793

(22) Filed: Jun. 11, 2009

(65) Prior Publication Data

US 2010/0313778 A1 Dec. 16, 2010

(51) Int. Cl.
*B41F 35/00* (2006.01)

(52) U.S. Cl.
USPC ..... 101/425; 101/423

(58) Field of Classification Search
USPC ..... 101/425
See application file for complete search history.

(56) References Cited

U.S. PATENT DOCUMENTS

| | | | | |
|---|---|---|---|---|
| 4,920,880 | A * | 5/1990 | Hara et al. | 101/425 |
| 5,322,015 | A | 6/1994 | Gasparrini | |
| 5,367,955 | A * | 11/1994 | Hara et al. | 101/424 |
| 5,373,789 | A * | 12/1994 | Waizmann | 101/423 |
| 5,479,857 | A * | 1/1996 | Braun | 101/423 |
| 5,519,914 | A | 5/1996 | Egan | |
| 5,644,986 | A | 7/1997 | Gydesen | |
| 5,727,470 | A * | 3/1998 | Kurzer et al. | 101/425 |
| 5,758,577 | A * | 6/1998 | Ebina | 101/423 |
| 5,842,418 | A * | 12/1998 | Corrado et al. | 101/425 |
| 5,918,545 | A | 7/1999 | Pym | |
| 5,964,007 | A * | 10/1999 | Wisniewski et al. | 15/256.53 |
| 6,645,349 | B1 * | 11/2003 | Koivukunnas et al. | 162/272 |
| 7,011,025 | B2 | 3/2006 | Egan | |
| 2005/0061182 | A1 * | 3/2005 | Ebina et al. | 101/425 |
| 2006/0230963 | A1 * | 10/2006 | Birger | 101/425 |

FOREIGN PATENT DOCUMENTS

| | | | |
|---|---|---|---|
| WO | WO9700173 | A1 | 1/1997 |
| WO | WO9746388 | A1 | 12/1997 |

OTHER PUBLICATIONS

ISA/KR, International Search Report and Written Opinion from corresponding PCT Application No. PCT/US2010/033813 filed May 6, 2010, as completed on Dec. 27, 2010 (total 9 pgs.).

* cited by examiner

*Primary Examiner* — Anthony Nguyen
(74) *Attorney, Agent, or Firm* — Christensen O'Connor Johnson Kindness PLLC

(57) ABSTRACT

A dry cleaner apparatus for cleaning at least one flexographic printing plate carried on a plate cylinder includes a frame for traveling along a path parallel to the axis of rotation of the plate cylinder, an unwind spindle rotatably attached to the frame, the unwind spindle holding a rolled web of dry cleaning material for turning to dispense new dry cleaning material, a rewind spindle for turning to roll up used dry cleaning material, a motor attached to the frame and coupled to one or both spindles to turn the spindles and thereby dispense new dry cleaning material and rewind used dry cleaning material, a pad assembly including a pad retainer, a pad base, and a dry pad, and a linear actuator attached to the frame and operating on the pad assembly to urge the dry pad toward the flexographic printing to remove ink and debris from the surface thereof.

7 Claims, 8 Drawing Sheets

DRY FLEXOGRAPHIC PRINTING PLATE CLEANER SYSTEM AND METHOD

TECHNICAL FIELD

The present invention relates to printing plate cleaning devices, and more specifically, to a dry flexographic printing plate cleaner system and method. Even more particularly, the invention relates to a system and method of cleaning the outer surface of a flexographic printing plate, while the printing plate is rotating on a plate cylinder, by using a web of dry cleaning material intermittently fed from a supply and urged against the outer surface of the printing plate by a linear actuator and associated dry pad assembly.

BACKGROUND INFORMATION

In order to improve on manual methods of cleaning printing plates, which involved bringing the rotating plate cylinders to a halt and wiping the printing plates by hand, automatic printing plate cleaners have been developed. Many automatic printing plate cleaners utilize a liquid solution to remove dust, fibers, particles, ink, or other foreign materials from a printing plate. For example, U.S. Pat. No. 5,918,545 to Pym discloses an apparatus for cleaning a flexographic printing plate by utilizing a brush roller to scrub the plate by rotating and oscillating against the plate. To increase the brush's effectiveness, a flicker bar is then utilized to intermittently engage the bristles of the brush in order to remove debris. One disadvantage of this design is that a rotating and oscillating brush can be effective to loosen foreign particles from the plate but is less effective at permanently removing the particles when compared to absorbent material such as a sponge or a cloth. Because utilizing a brush only disrupts ink residue remaining on the plate surface after the transfer of ink to the media, a significant portion of the ink is not captured and removed from the plate surface resulting in poor print quality. Another disadvantage of a brush is that it is more likely to abrade the surface of the flexographic printing plate which is made of polymeric material that is easily damaged and/or scratched. Pym also teaches a cleaning fluid applicator for supplying detergent and water to the brush roller and subsequently to the printing plate. Disadvantageously, cleaning fluid tends to remain on the plate and negatively affect print quality and also requires additional apparatus complexity and expense to allow for both the application and removal of the fluid. Accordingly, the Pym apparatus includes a drain tray configured to receive waste fluid and debris and remove both from the apparatus. Subsequently, a drying unit is positioned to provide a pressurized air stream across the length of the printing plate in order to remove excess fluid and dry the plate. Another disadvantage of the apparatus is that because the process, including the drying cycle, requires that the press be stopped, throughput of printed material is significantly reduced.

In order to provide a cleaning apparatus that does not require the use of a liquid and associated disadvantages, U.S. Pat. No. 5,322,015 to Gasparrini discloses a rotating brush cleaning system for removing debris, dust, lint, and ink from a printing cylinder. Although the process taught by Gasparrini is completely dry, disadvantageously, both a rotating spiral brush and a vacuum system are utilized. The spiral brush has the disadvantages of using a brush noted above and the vacuum system adds unnecessary cost and complexity to the cleaning system. Although Gasparrini generally teaches that the brush cleaner is periodically urged against the printing device, the brush cleaner and vacuum system can remain engaged while the press is operational thereby reducing press downtime.

Although U.S. Pat. No. 5,644,986 to Gydesen discloses a method and apparatus for cleaning flexographic printing cylinders that does not require brushes and can also be engaged while the press is operational, the method involves detaching dust, fibers, and other foreign objects by complex means of directing pressurized fluid of air, liquid, or solid matter particles on to the plate surface to loosen ink and foreign particles. The application of liquid has the disadvantages discussed above and applying solid matter particles increases the likelihood of damaging the printing plate. Although pressurized air is less likely to be abrasive, absent physical engagement with the plate surface, dry ink and other foreign particles are more likely to remain, thereby reducing print quality. Adding to the complexity of the design, a vacuum/suction and collection system is used to remove particles loosened from the plate surface by the pressurized air, liquid, or solid matter particles. This removal system has several disadvantages including the significant purchasing, operating, and maintenance costs required for the vacuum, blower and pump infrastructure. Furthermore, the effectiveness of the system is significantly reduced due to its reliance on uniform plate thickness. Because plates vary in thickness from one another and potentially across each specific surface, the precise setting of the apparatus at a specific distance from one plate surface will likely lead to diminished quality prints in successive printing plate changes.

To overcome many of the above disadvantages, a flexographic printing plate cleaner was disclosed by U.S. Pat. No. 7,011,025 to Egan, incorporated herein by reference, which utilizes a sponge pad and cloth instead of a brush thereby effectively cleaning the printing plate through absorption means while significantly reducing the likelihood of harming the surface of the printing plate. Since the sponge pad in combination with the cloth allows for increased and relatively effective absorption, the need for a vacuum system is also eliminated. The cleaning apparatus also engages the printing plate while the press is in operation to significantly reduce press downtime. However, fluid is applied to the sponge pad as it is urged against the cloth and, subsequently, against the printing plate. Although the absorbent sponge pad and cloth significantly reduce fluid residue capable of effecting print quality, the application of any amount of liquid can increase the likelihood of fluid residue which is disadvantageous. Another disadvantage is the complexity and cost associated with the means necessary to provide fluid to the apparatus and inject the fluid to the sponge pad.

Accordingly, there is a need in the art for a simple and dry cleaner apparatus for effectively cleaning at least one flexographic printing plate that does not require abrasive brushing, the deposition of cleaning fluid, or a vacuum system, while still eliminating press downtime by engaging the printing plate while the press is in operation without diminishing print quality.

BRIEF DESCRIPTION OF THE DRAWINGS

These and other features and advantages will be better understood by reading the following detailed description, taken together with the drawings wherein.

DETAILED DESCRIPTION

Figure 1:
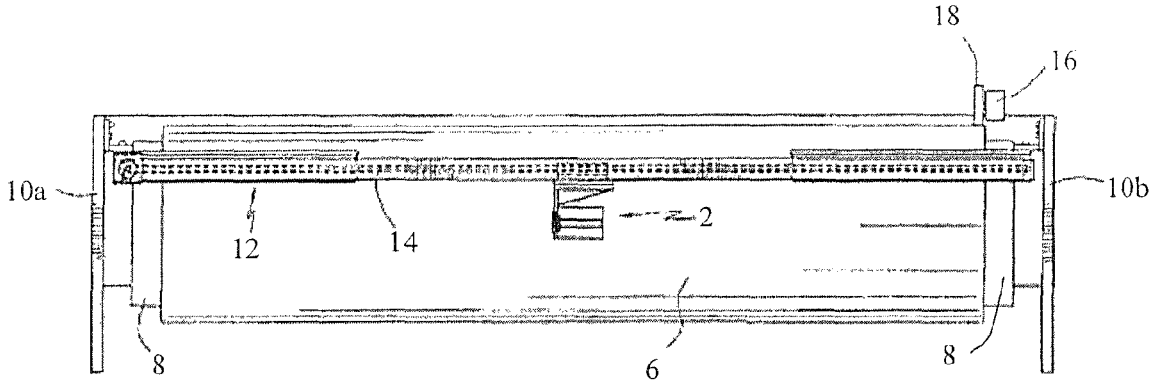
FIG. 1 is a top plan view of a flexographic printing plate cleaner mounted to a printing plate cylinder.

Referring to FIG. 1, a flexographic printing press includes a cylinder assembly including a cylinder 8 which rotates along its axis 3 between end supports 10 wherein the cylinder 8 can be configured to carry a printing plate 6. Although embodiments of the invention will be described using a flexographic printing cylinder and/or plate, it should be understood that the invention may be used on a variety of different types of press and printing equipment.

One embodiment of a dry flexographic printing plate cleaner 2 is configured to traverse at least the length of a printing plate 6. Means for traversing the plate cleaner includes a motor and track system 12 configured to engage a frame 20 of the plate cleaner. The motor can be an electric stepper motor, a hydraulic motor, a pneumatic motor, a band drive motor, a belt drive motor, an electro-mechanical actuator, or any other type of linear actuator, for example, and is configured to move along a track such as a band, a chain or an endless toothed belt, for example, preferably substantially parallel to the axis of rotation of the plate cylinder 8. The plate cleaner 2 frame 20 has one end disposed towards the printing plate 6 and a pad assembly disposed toward the one end, the pad assembly 30 being described further below and shown in greater detail in FIGS. 2-5. A speed encoder 16 and associated encoder wheel 18 are also provided so as to monitor the rotational speed of the plate cylinder 8 and provide the speed information to the motor and track system 12. According to the cylinder speed information, the traverse speed of the plate cleaner 2 is adjusted by the motor 46 to allow for substantially constant contact with the printing plate 6.

Figure 2:
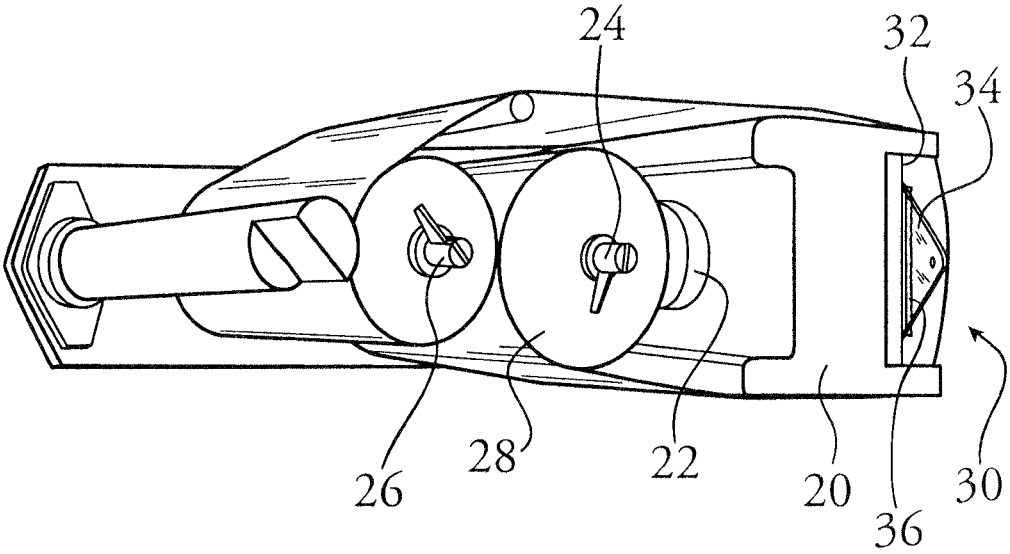
FIG. 2 is a side perspective view of a dry flexographic printing plate cleaner including a pad assembly.
Figure 3:
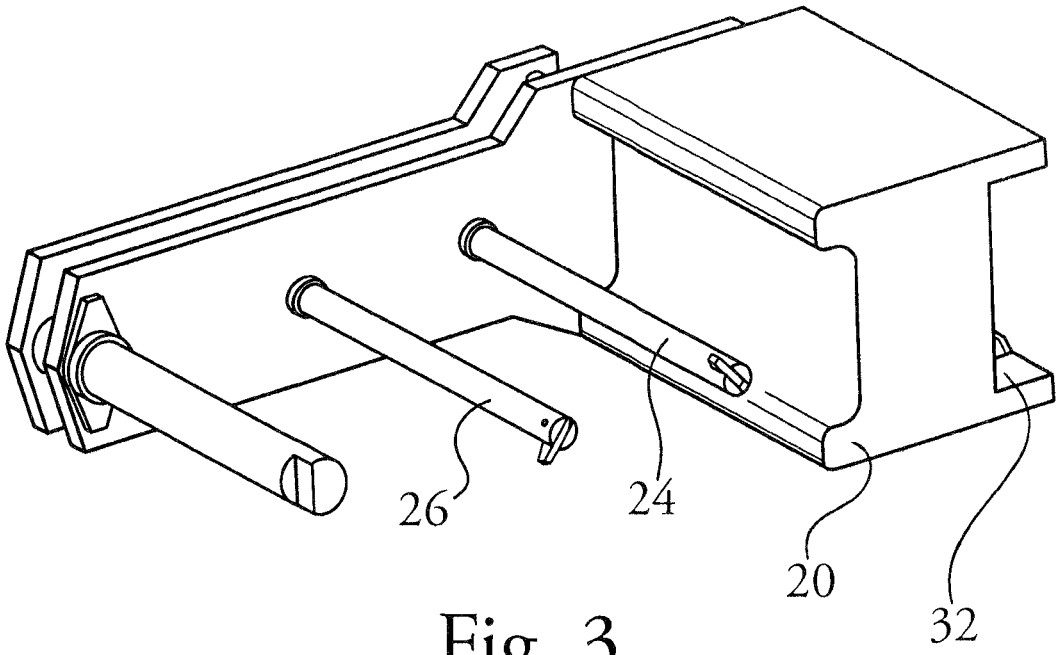
FIG. 3 is a perspective view of a dry flexographic printing plate cleaner frame including pad retainer and spindles.
Figure 7:
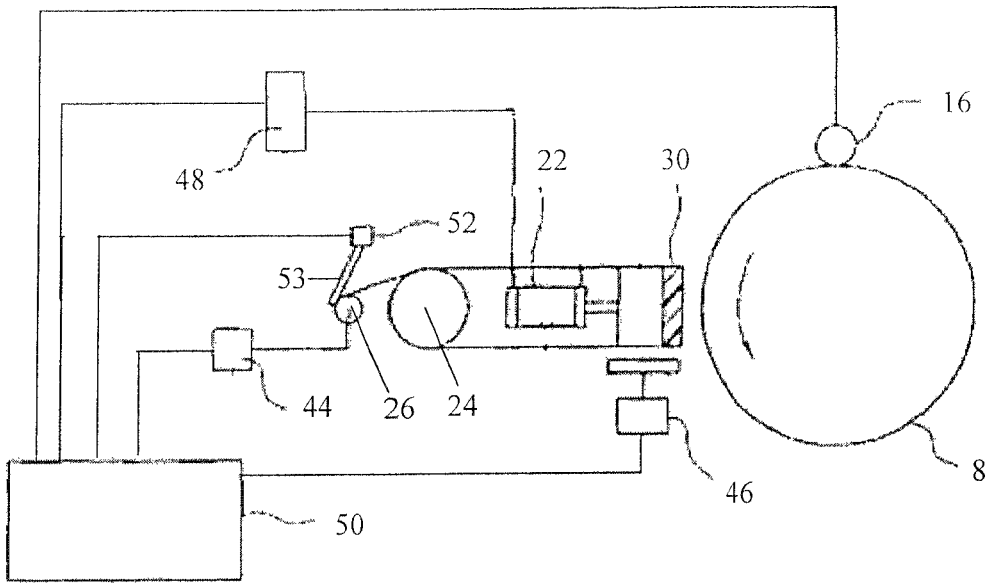
FIG. 7 is schematic view of a dry flexographic printing plate cleaner system.

Referring to FIGS. 2 and 3, one embodiment of a dry flexographic printing plate cleaner 2 is shown generally as having a frame 20, an unwind spindle 24, a rewind spindle 26, a linear actuator 22, a pad assembly 30, and a web of dry cleaning material 28. At least one unwind spindle 24 and at least one rewind spindle 26 are rotatably attached to the frame 20 whereby the axis of rotation of each of the spindles 24, 26 is substantially parallel to the axis of rotation of the plate cylinder 8. The unwind spindle 24 is configured to hold a rolled web of dry cleaning material 28 and rotates so as to dispense new dry cleaning material 28. The rewind spindle 26 is configured to hold a rolled web of used dry cleaning material 28 and rotates so as to receive used dry cleaning material 28. The dry cleaning material 28 is attached to the unwind spindle 24 at a first end and to the rewind spindle 26 at a second end. Dry cleaning material 28 may be any absorbent cloth material preferably including woven polyester. A spindle motor 44, described further below and shown in greater detail in FIG. 7, is attached to the frame 20 and coupled to one or, preferably, both spindles 24, 26 to turn the spindles 24, 26 and thereby dispense new cleaning material 28 and rewind used cleaning material 28. The unwind spindle 24 dispenses new dry cleaning material 28 in a direction towards the one end of the frame 20 disposed toward the printing plate 6 such that the dry cleaning material 28 travels in a path between the pad assembly 30 and the printing plate 6 and eventually to the rewind spindle 24.

Still referring to FIGS. 2 and 3, a dry flexographic printing plate cleaner 2 includes a pad assembly 30 disposed on a side of the path of the web of dry cleaning material 28 disposed toward the frame 20 such that the pad assembly 30 is disposed between the frame 20 and the dry cleaning material 28. One embodiment of a pad assembly 30 includes a pad retainer 32, a pad base 34, and a dry pad 36. The pad assembly 30 moves toward the cleaning material 28 and printing plate 6 by operation of and engagement with a linear actuator 22 attached to the frame 20. The linear actuator 22 moves toward and away from the pad assembly 30 to urge the dry pad 36 toward the printing plate 6 to engage the dry cleaning material 28 on one side and urge the other side of the dry cleaning material 28 against the printing plate 6 so as to remove ink and debris from the printing plate 6 surface. The linear actuator may be an electric, electro-mechanical, piezoelectric, electric stepper, hydraulic, servo and/or pneumatic motor, for example. In one embodiment, the linear actuator may be a pneumatic, double action piston and cylinder whereby the piston is movable to either a first or second position whereby one of the two positions is closer to the plate cylinder 8 than the other position such that in the position closer to the plate cylinder 8, the dry cleaning material 28 can engage the surface of the printing plate 6.

Figure 4:
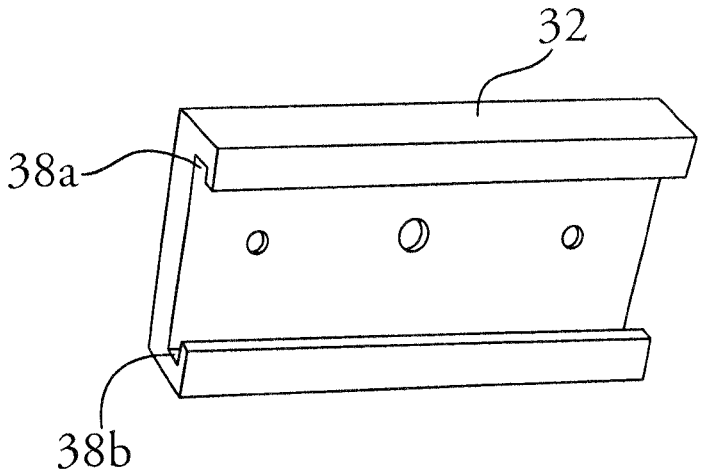
FIG. 4 is a front perspective view of a pad retainer including a pad retainer groove.

Referring to FIGS. 3 and 4, a pad assembly 30 includes a pad retainer 32 having at least one groove 38, and preferably including two grooves 38. The pad retainer 32 may be attached to the linear actuator 22 by adhesive, at least one screw, at least one bolt, at least one bracket, at least one brace, and/or at least one magnet, for example, or any other means of attachment. The pad retainer 32 is configured to receive a pad base 34 at the at least one groove 38 such that movement toward and away from the printing plate 6 at the urging of the linear actuator 22 will not displace the pad base 34 in either the direction of the urging or in the vertical direction. Optionally, one end of the at least one groove 38 may be configured such that engagement with the groove 38 of the pad retainer 32 by the pad base 34 will not allow the pad base 34 to extend beyond the edge of the pad retainer 32 thereby limiting the movement of the pad base 34 in the horizontal direction.

Figure 5:
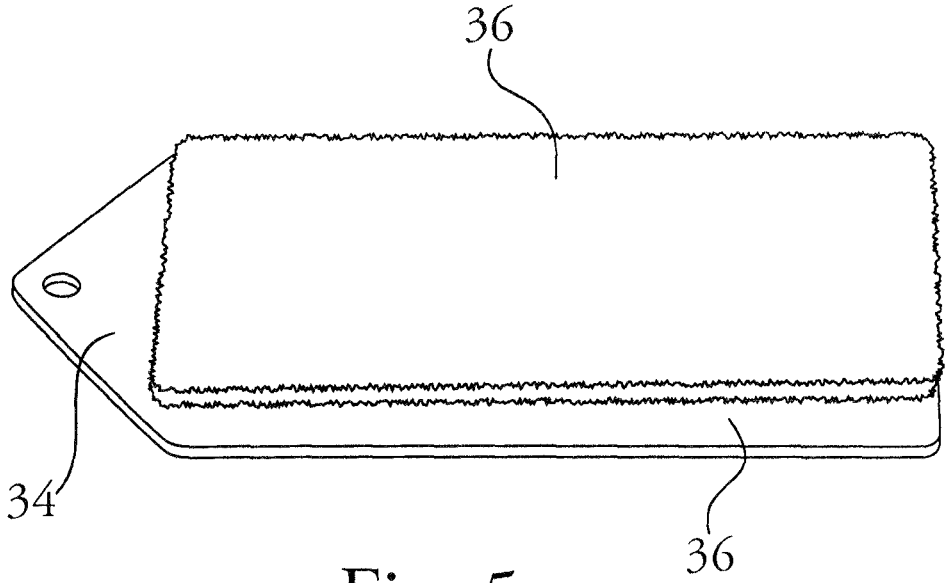
FIG. 5 is side perspective view of a pad base and a pad.

Referring to FIGS. 4 and 5, a pad assembly 30 includes a pad base 34 and a dry pad 36 whereby at least a portion of the pad base 34 is configured to engage at least one groove 38 in the pad retainer 32 as described above. Preferably, the pad base 34 is made from a thermoplastic polycarbonate resin such as Lexan®, currently marketed and sold by SABIC Innovative Plastics. In one embodiment, the pad base 34 is sized to be wider than the pad 36 such that the pad base 34 engages the pad retainer 32 such that no portion of the dry pad 36 extends into the groove 38. In another embodiment, the pad base 34 may be longer than the dry pad 36 such that a portion of the pad base 34 can be easily handled by an operator when replacing the dry pad 36 and/or pad base 34. The extended portion 35 of the pad base 34, allowing for increased speed of a dry pad 36 and/or pad base 34 change, can reduce plate cleaner 2 and/or printing press downtime Referring specifically to FIG. 5, in one embodiment, a dry pad 36 is configured to attach to a pad base 34 by attachment means such as adhesive, at least one screw, at least one bolt, at least one bracket, at least one brace, and/or at least one magnet, for example, or any other means of attachment. The dry pad 36 is sufficiently malleable and non-abrasive such that the surface of the printing plate 6 being cleaned is not damaged but also sufficiently rigid such that foreign matter is removed by the engagement of the dry pad 36 and cleaning material 28 with the printing plate 6. Preferably, a foam type pad 36 having an open cell structure and including, at least in part, a polyurethane polymer material may be utilized.

Figure 6:
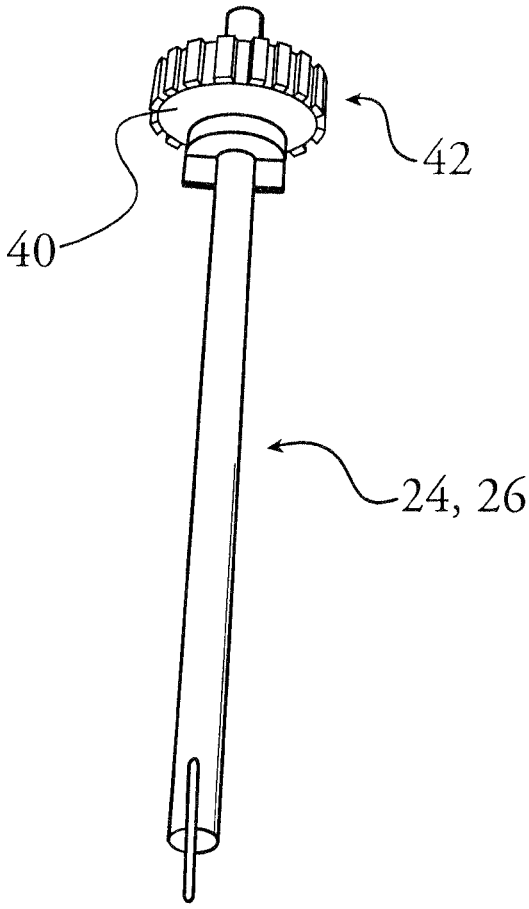
FIG. 6 is a top perspective view of a spindle including a gear.

Referring now to FIGS. 6 and 7, a spindle representative of both unwind 24 and rewind 26 spindles is shown as having a gear 40 including a plurality of teeth 42. In operation, a spindle motor 44 attached to the frame 20 engages the gear 40 so as to rotate with the spindles 24, 26. The spindle motor 44 is controlled by a controller 50 (not shown), as described further below and shown in greater detail in FIGS. 7-8. The spindle motor 44 may be a fixed speed motor such that dry cleaning material 28 is advanced at the same speed at each interval as both the speed and the interval are either received and/or determined by the controller 50. However, as the diameter of the unwind spindle 24 is reduced and as more dry cleaning material 28 is received by the rewind spindle 26, maintaining a fixed speed of spindle 24, 26 rotation can cause an increased amount of cleaning material 28 waste. Accordingly, the number of cleaning material 28 advances may be monitored by the controller 50 which may be configured to adjust the speed of the spindle motor 44 such that the unwind and/or rewind spindle(s) 24, 26 rotates an appropriate amount so as to reduce cleaning material 28 waste. Preferably, a proximity sensor having a nominal range extending at least beyond the surface of the gear or a mechanical switch for example, is configured to both count the number of teeth 42 on the gear 40 of at least one of the spindles 24, 26 that rotate each cleaning material 28 advance interval and communicate the information to the controller 50. Accordingly, the controller 50 more precisely adjusts the spindle motor 44 speed for each successive cleaning material 28 advance thereby reducing cleaning material 28 waste.

Referring specifically to FIG. 7, a schematic overview of the various components of a dry flexographic printing plate cleaner 2 system are shown. In one embodiment, the components are controlled by a programmable controller 50. The controller 50 includes a processor or microprocessor, at least one storage device such as an optical hard drive, magnetic hard drive, random access memory, and/or read only memory, a system bus, a display, and at least one input device such as a keyboard and/or touchscreen display, among other components. The controller 50 is configured to store and execute instructions based on user input and sensor information and to execute programs in accordance with those instructions to manipulate various components of the plate cleaner 2 system including the motor 46 for traversing the plate cleaner 2, the compressor/pump 48, and the spindle motor 44. The controller 50 operates the motor 46 of the motor and track system 12 in order to traverse the plate cleaner 2 along the length of a printing plate 6. When the plate cleaner 2 arrives at the end of a printing plate 6 or at a plate cylinder 8 end support (see FIG. 1), the controller 50 operates the compressor 48 by turning it on and off and sending signals to valves on a hydraulic/pneumatic cylinder/piston to open and close pressure and drain lines between a pump, sump/vent, and cylinder to pressurize one side of the cylinder and urge the piston of the linear actuator in one direction or the other. Accordingly, the linear actuator urges the pad assembly both away from the printing plate 6, to a retracted position, prior to advancing dry cleaning material 28 and toward the printing plate 6, to an extended position, subsequent to advancing dry cleaning material 28. In order to advance the dry cleaning material 28 at each interval, the controller 50 executes instructions and sends signals to the spindle motor 44 to effectuate rotation of the unwind spindle 24 and/or the rewind spindle 26 in order to present unused dry cleaning material 28 to the pad assembly 30 for urging against the printing plate 6.

Still referring to FIG. 7, the controller 50 receives input signals from the speed encoder 16 as discussed above and the proximity sensor (not shown) as discussed above. A low cleaning material sensor 52, including a pivot arm 53 disposed against the used dry cleaning material 28 and a sensor or switch, may send an input signal to the controller 50 as the used dry cleaning material 28 increases in diameter and the pivot arm 53 pivots to eventually activate the sensor or switch.

Figure 8:
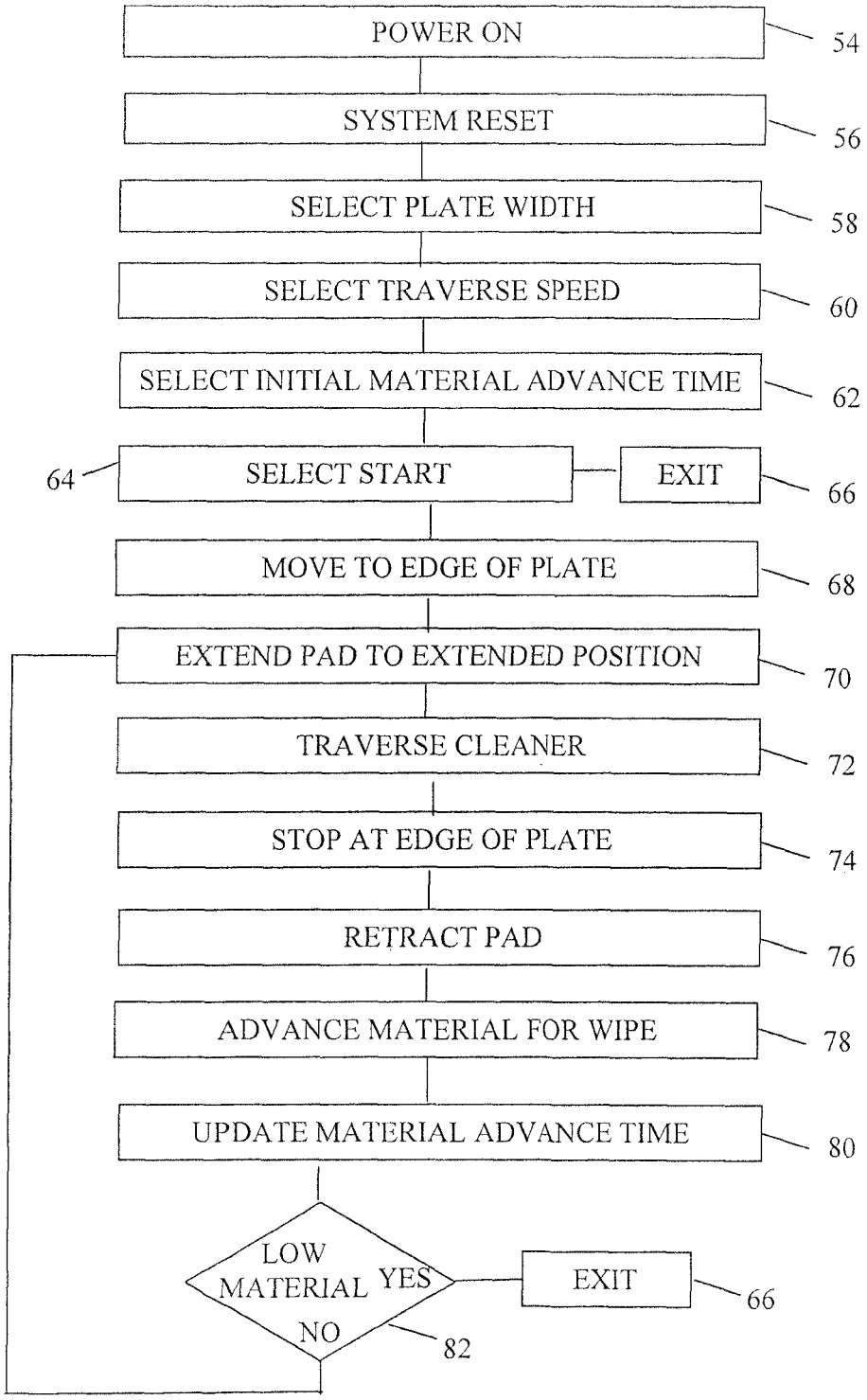
FIG. 8 is a flowchart showing the operation of the flexographic printing plate cleaner of the present invention.

In one embodiment, in order to perform operations on the components of the plate cleaner 2, the controller 50 stores and executes instructions as discussed above, in the form of a software and/or hardware program configured to operate as shown in FIG. 8. To operate one embodiment of the system, an operator powers on 50 the printing plate cleaner system and the system may reset 56 itself such as by clearing any stored values or input variables from memory. The operator then selects or enters the plate width 58 and the value selected or entered is stored in a storage device such as random access memory in the controller 50 such that the controller may use the value to control the traverse distance of the plate cleaner 2. The operator then selects or enters a traverse speed 60 and then an initial cleaning material advance time 62 and both values are stored and subsequently used by the controller 50. The operator then either starts 64 the plate cleaner cycle or exits the current instantiation of the program by exiting and, in effect, powering the system off 66. If the operator elects to start the cycle, the plate cleaner 2 either be moves manually, or under control of the controller 50, to one edge of the printing plate. At any point prior to extension of the pad assembly 30 to the extended position, the operator may attach the dry cleaning material 28 by attaching one end of the dry cleaning material 28 to the unwind spindle 24 and wrapping the other end of the dry cleaning material 28 around the portion of the pad assembly 30 configured to be disposed toward the printing plate 6 and the frame 20 and attaching it to the rewind spindle 26.

In one embodiment, as the plate cleaner 2 begins its cycle, the controller 50 operates the compressor 48 to extend the pad assembly 30 to the extended position thereby urging the dry pad 36 against the cleaning material 28 and the cleaning material 28 against the printing plate 6 surface. The controller 50 then uses the stored traverse speed value to operate the motor and track system 12 to traverse the plate cleaner 2. The controller 50 then uses the stored plate width value in combination with the stored traverse speed value to stop the plate cleaner 2 at the edge of the printing plate 6 or plate cylinder 8. The plate cleaner then operates the compressor 48 to retract the pad assembly 30. Next, the controller operates the spindle motor 44 to advance the dry cleaning material 28 to present the dry pad 36 with unused dry cleaning material 28 from the unwind spindle 24. As the spindle(s) 24, 26 rotate, a proximity sensor counts the number of rotating gear 30 teeth 42 and sends the information to the controller 50 which updates the cleaning material advance time which is used at the next cleaning material advance interval. As the unused dry cleaning material 28 is rolled up by operation of the spindle motor 44 in combination with the rewind spindle 26, the low cleaning material sensor 52 and associated pivot arm 53 sends a signal to the controller 50 when the dry cleaning material 28 needs replacement. If a signal is sent by the low cleaning material sensor 52, the controller automatically exits and powers off allowing the operator to replace the dry cleaning material 28. Assuming no signal is sent by the low cleaning material sensor 52 to the controller 50, the controller 50 operates the compressor 48 to extend the pad assembly 30 to the extended position, thereby continuing the cleaning cycle of the plate cleaner system.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A dry absorbent, non-abrasive cleaner apparatus for cleaning wet ink from a raised, flexible printing surface of at least one flexographic printing plate carried on a plate cylinder, comprising:

a frame for traveling along a path parallel to the axis of rotation of the plate cylinder, the frame further comprising one end configured to be disposed toward the printing plate;

at least one unwind spindle rotatably attached to the frame, the unwind spindle having an axis of rotation substantially parallel to that of the plate cylinder, the unwind spindle holding a rolled web of dry absorbent cleaning material for absorbing wet ink and for turning to dispense new dry cleaning material;

at least one rewind spindle for turning to roll up used dry cleaning material, the rewind spindle being rotatably attached to the frame and having an axis of rotation substantially parallel to that of the plate cylinder;

a spindle motor attached to the frame and coupled to one or both spindles to turn the spindles and thereby dispense new dry cleaning material and rewind used dry cleaning material;

a pad assembly having a pad retainer configured to be disposed toward the one end of the frame, the pad retainer further including at least one groove, a pad base wherein at least a portion of the pad base is configured to engage the at least one groove of the pad retainer, and a dry, non-abrasive pad configured to be attached to the pad base; and a linear actuator attached to the frame for moving the pad toward and away from the dry cleaning material, the linear actuator disposed between the unwind and rewind spindles and the pad assembly and operating on the pad assembly to urge the pad toward the flexographic printing plate for non-abrasively engaging the dry absorbent cleaning material on one side and urge the other side of the dry absorbent cleaning material against the ink on the raised surface of the flexographic printing plate to remove the wet ink and debris from the raised surface thereof.

2. The dry absorbent, non-abrasive cleaner apparatus of claim 1 wherein said web of dry absorbent cleaning material comprises dry absorbent cleaning cloth having a first end and a second end wherein the dry absorbent cleaning cloth is configured to attach to the unwind spindle at the first end and the rewind spindle at the second end and wherein the dry absorbent cleaning cloth includes woven polyester.

3. The dry absorbent, non-abrasive cleaner apparatus of claim 1 wherein the pad base includes thermoplastic polycarbonate resin material.

4. The dry absorbent, non-abrasive cleaner apparatus of claim 1 wherein the dry non-abrasive pad includes an open cell structure and further includes a polyurethane polymer material.

5. The dry absorbent, non-abrasive cleaner apparatus of claim 1 wherein the linear actuator is a double action linear actuator selected from the group consisting of an electric motor, an electro-mechanical motor, a piezoelectric motor, an electric stepper motor, a hydraulic motor, a servo motor, and a pneumatic motor.

6. The dry absorbent, non-abrasive cleaner apparatus of claim 1 wherein the unwind spindle further includes a first end disposed toward the frame wherein the first end includes a gear having a plurality of teeth wherein the gear is configured to be engaged by the spindle motor.

7. The dry absorbent, non-abrasive cleaner apparatus of claim 6 further including means for determining the rotation speed of the unwind spindle selected from the group consisting of a proximity sensor configured to transmit a signal representing a specific of number of teeth and a mechanical switch.

* * * * *

UNITED STATES PATENT AND TRADEMARK OFFICE

CERTIFICATE OF CORRECTION

PATENT NO. : 8,590,449 B2
APPLICATION NO. : 12/482793
DATED : November 26, 2013
INVENTOR(S) : R. G. Egan It is certified that error appears in the above-identified patent and that said Letters Patent is hereby corrected as shown below:

In the Claims

| COLUMN | LINE | ERROR |
|---|---|---|
| 8 (Claim 7, line 5) | 41 | "specific of number" should read --specific number-- |

Signed and Sealed this
First Day of September, 2015

Michelle K. Lee

Michelle K. Lee
*Director of the United States Patent and Trademark Office*